US008894174B2

(12) United States Patent
Sethne et al.

(10) Patent No.: US 8,894,174 B2
(45) **Date of Patent: *Nov. 25, 2014**

(54) SWATH HEIGHT ADJUSTMENTS

(75) Inventors: Yngvar Rossow Sethne, Barcelona (ES); Utpal Kumar Sarkar, Sant Quirze del Valles Barcelona (ES); Marcos Casaldaliga Albisu, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 239 days.

This patent is subject to a terminal disclaimer.

(21) Appl. No.: 13/408,383

(22) Filed: Feb. 29, 2012

(65) Prior Publication Data

US 2012/0212527 A1 Aug. 23, 2012

Related U.S. Application Data

(63) Continuation-in-part of application No. 13/032,875, filed on Feb. 23, 2011, now Pat. No. 8,651,610.

(51) Int. Cl.
*B41J 29/38* (2006.01)
*B41J 2/21* (2006.01)
*B41J 29/393* (2006.01)

(52) U.S. Cl.
CPC ..... *B41J 2/2132* (2013.01); *B41J 29/38* (2013.01); *B41J 29/393* (2013.01)
USPC ..... 347/16; 347/14

(58) Field of Classification Search
CPC ..... B41J 11/42; B41J 29/393; B41J 29/38; B41J 11/0095; B41J 3/60
USPC ..... 347/9, 14, 15, 16, 19
See application file for complete search history.

(56) References Cited

U.S. PATENT DOCUMENTS

| | | | | |
|---|---|---|---|---|
| 6,250,824 | B1 * | 6/2001 | Ogiyama | 400/120.03 |
| 6,454,474 | B1 | 9/2002 | Lesniak et al. | |
| 6,520,700 | B1 * | 2/2003 | Iwata | 400/582 |
| 6,641,242 | B2 | 11/2003 | Canti et al. | |
| 7,036,904 | B2 | 5/2006 | King et al. | |
| 7,431,522 | B2 | 10/2008 | Linville et al. | |
| 7,537,334 | B2 | 5/2009 | Yang et al. | |
| 7,543,927 | B2 | 6/2009 | Campillo et al. | |
| 7,845,751 | B2 | 12/2010 | Rueby | |
| 8,651,610 | B2 * | 2/2014 | Sethne et al. | 347/16 |
| 2002/0130914 | A1 * | 9/2002 | Mantell et al. | 347/15 |
| 2003/0058295 | A1 | 3/2003 | Heiles et al. | |

(Continued)

FOREIGN PATENT DOCUMENTS

JP 2011189729 A 9/2011

*Primary Examiner* — Manish S Shah
*Assistant Examiner* — Yaovi Ameh

(57) ABSTRACT

In one example, a first swath is caused to be printed by a print unit on a media. The media is advanced with respect to the print unit. For a nominal second swath to be printed to beneath and adjacent to the first swath, a plurality of adjustment regions along the width of the nominal second swath are determined in accordance with a profile of non-constant advance errors for the media. An adjusted second swath is formed by, for each of the regions, adjusting the height of the nominal second swath in memory based on the determined amount of advancement error for the region. The print unit is caused to print the adjusted second swath on the media.

18 Claims, 11 Drawing Sheets

(56) References Cited

U.S. PATENT DOCUMENTS

2003/0132979 A1* 7/2003 Taylor ..... 347/19
2004/0075727 A1* 4/2004 Rufes et al. ..... 347/104
2005/0146548 A1 7/2005 de Pena et al.
2005/0253911 A1* 11/2005 Spinelli et al. ..... 347/101
2008/0246984 A1* 10/2008 Shoji ..... 358/1.13
2010/0220140 A1* 9/2010 Yoshida et al. ..... 347/16

* cited by examiner

SWATH HEIGHT ADJUSTMENTS

CROSS REFERENCE TO RELATED APPLICATION

This application is a continuation-in-part of U.S. patent application Ser. No. 13/032,875, entitled "Image Forming System and Methods Thereof," which was filed on Feb. 23, 2011, now U.S. Pat. No. 8,651,610 and is hereby incorporated by reference.

BACKGROUND

Printers may include a print unit to print swaths on media to form images and a media transport unit to transport the media to the print unit. The printed images may include distortions from overprinting, banding, and/or other artifacts based on respective advancement errors corresponding to the transportation of the media. Such printers may include inkjet printing systems.

BRIEF DESCRIPTION OF THE DRAWINGS

The accompanying drawings illustrate various examples and are a part of the specification. The illustrated examples do not limit the scope of the claims. Throughout the drawings, identical reference numbers designate similar, but not necessarily identical elements.

The same part numbers designate the same or similar parts throughout the figures.

DETAILED DESCRIPTION OF EMBODIMENTS

Figure 1:
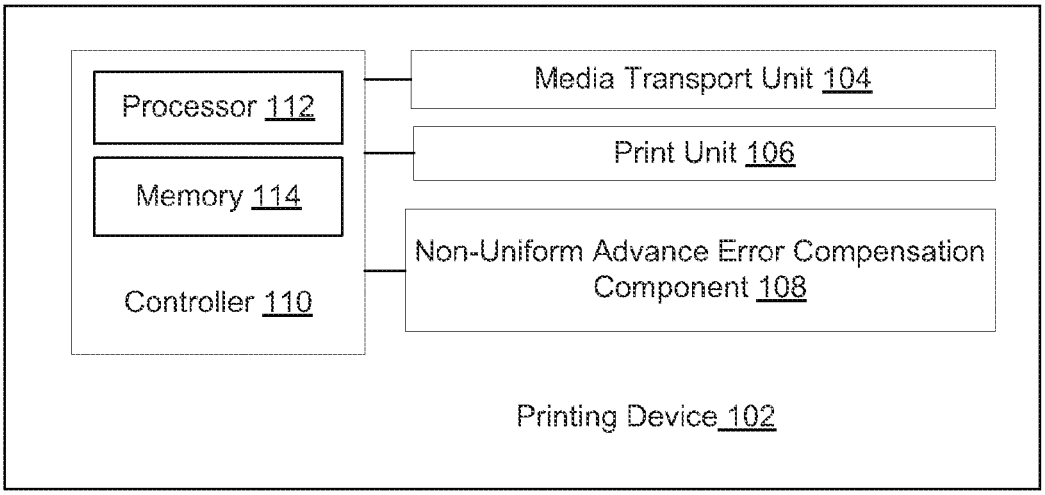
FIG. 1 is a block diagram illustrating a system according to various examples.

Printers may include a print unit to print swaths on media to form images thereon, and a media transport unit to transport the media to the print unit between printing passes. The printed images may include distortions from overprinting, banding, and/or other image artifacts based on non-constant media advances of the media in relationship to a scan axis. Even a small error in media advancement may cause an artifact on printed image that is visible to a user.

Manufacturers of printers have attempted to reduce such artifacts by several traditional means. First, the printer may perform additional printing passes in order to hide the artifacts of the advance error. This solution may have a considerable trade-off of productivity loss, however. Another method to try to reduce such artifacts is to take steps to improve the transport system to move the media advance error as close to zero as possible. Improving the transport system may increase the cost of the printer, however, and may not practical in certain situations. Further, the methods described above may be considerably complicated, or impractical, when the media advance errors are non-constant during a print unit pass along a scan axis.

Accordingly, various embodiments described herein were developed to provide a method, a system, and a computer-readable medium containing instructions to reduce or eliminate advance error artifacts that result from media advances that are non-constant along the scan axis. The disclosure allows for the reduction or elimination of artifacts without employing additional print unit passes relative to the media, and without hardware upgrades to improve the media transport system. The disclosed examples are likely to lead to higher quality printing and a better user experience for users of printers, in turn resulting in increased usage of printers that include embodiments of this disclosure.

As used in this application, a "printer" or "printing device" refers to any liquid inkjet printer, toner-based printer, solid ink printer, or any other electronic device that prints. "Printer" or "printing device" includes any multifunctional electronic device that performs a function such as scanning and/or copying in addition to printing. "Print unit" refers to a mechanism configured to dispense a marking agent upon the media as the print unit is moved along a scan axis across a media. "Marking agent" refers to any substance applied to a media during a printing operation, including but not limited to aqueous inks, solvent inks, UV-curable inks, dye sublimation inks, latex inks, and powders. "Image" refers to a representation or rendering of an object, scene, person, or an abstraction such text or a geometric shape. "Swath" refers to an area of marking agent deposited upon a media during a print unit pass. A "pass" of a print unit refers to an act of going over or across a media. "Swath height" refers to a measurement of the dimensions of a swath along an axis substantially perpendicular to the scan axis for the print unit. "Scan axis" of the print unit refers to an axis along which a print unit travels during printing. A "nominal" swath refers to a theoretical swath that may be adjusted to create an adjusted swath. "Media", "print media" are used synonymously and may include a pre-cut media, a continuous roll or web media, or any other article or object on which a printed image can be formed. A "sheet" of media refers to an incidence of media, such that a sheet of media may be an incidence of a pre-cut media, an incidence of a continuous roll or web media, or an incidence of any other article or object on which a printed image can be formed. "Adjustment region" refers to a region of a nominal swath that is adjusted to compensate for non-constant media advance error. A "non-constant" media advancement error is an advancement error that is non-uniform or irregular with respect to a width of media. Such errors can be the result of an irregular media advance, skewed media in relation to a scan axis, telescoping of media, media expansion or other media deformation, and/or other causes. "Artifact" refers to any distortion of a printed image relative to the intended appearance, including distortions resulting from overprinting or banding, made during printing of a swath. "Overprinting" refers to an artifact resulting from printing a first and second swath with an area of overlap. "Banding" refers to an artifact resulting from printing of a first and second swath with an area of unintended white space, unintended unprinted space, or an unintended gap between the swaths. "Rasterizing" content refers to processing or rendering of content to a format that can be understood and/or better understood by a printer.

FIG. 1 shows a printing device 102 representing generally a computing device that is operable to produce printed images upon a media. Printing device 102, for example, may be used for printing photographs, forms, advertisements, coupons and the like. In an example, printing device 102 may operate in conjunction with one or more host computing devices capable of communicating print jobs to printing device 102. In an example, printing device 102 connects directly or indirectly with a host computing device. In an example printing device 102 is connected to a host via a cable or wireless or other means in a manner such that printing device 102 may receive instructions and print jobs from host. In another example, printing device 102 may connect directly to one or more hosts via the Internet. In an example, printing device 102 may operate in a standalone mode without being connected to a host, the printing device 102 being configured to receive print jobs via the Internet, email or an external memory device.

In the example of FIG. 1, printing device 102 is shown to include a media transport unit 104, a print unit 106, a non-constant advance error compensation component 108, and a controller 110. Media transport unit 104 represents generally any combination of hardware and programming capable of transporting a media through printing device 102. The media may include a pre-cut media, a continuous roll or web media, or any other media on which a print image can be formed. Print unit 106 represents generally any combination of elements capable of being utilized to form desired images on a media. In various examples, print unit 106 may include varying technologies and components that cause printing of an image on a media, including but not limited to inkjet printing, thermal printing, and piezo-electric printing technologies. In examples, print unit 106 may include a printhead, such as a drop-on-demand inkjet printheads, thermo resistive printheads, piezo printheads, or resistive printheads. In certain examples print unit 106 may be part of a cartridge which also stores the marking agent to be dispensed. In other examples, print unit 106 is standalone and is supplied with marking agent by an off-axis marking fluid supply.

Non-constant advance error compensation component (sometimes referred to herein as a "NAEC component") 108 represents generally any programming, that, when executed, causes changes in swath heights to reduce or eliminate advance error artifacts that can result from media advances that are non-constant along the scan axis.

Figure 2:
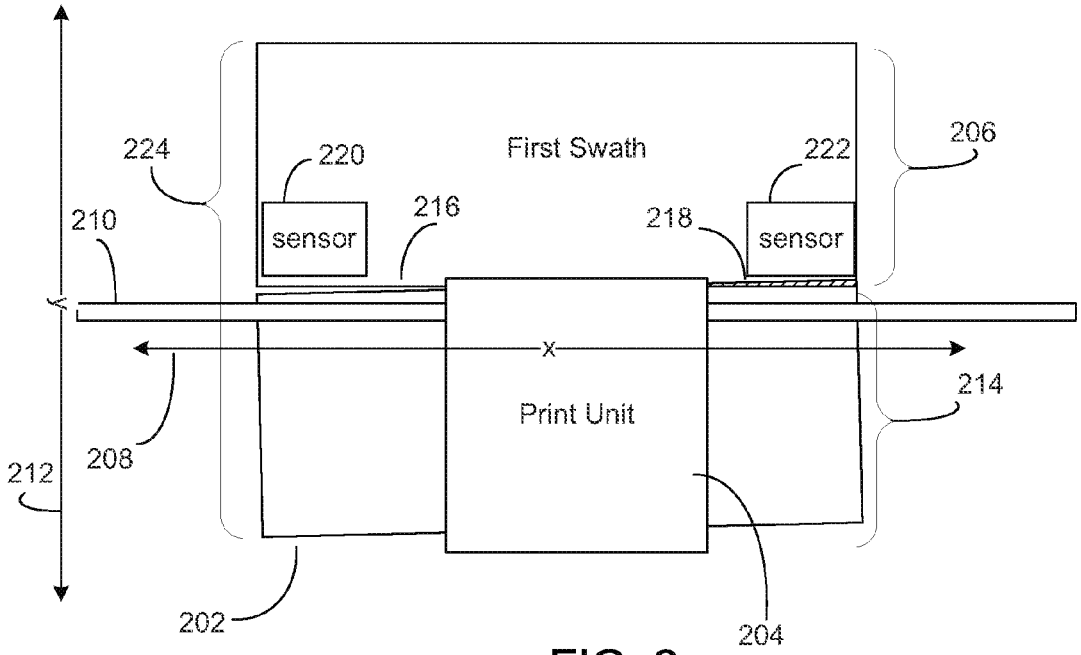
FIG. 2 is an example of printing of a first swath and a nominal second swath upon a single media sheet without correction for non-constant media advance errors, according to various examples.

Moving to FIG. 2 in view of FIG. 1, in an example NAEC component 108 receives a print job with instructions to print an image upon a media 202. NAEC component 108 causes printing, by a print unit 204, of a first swath 206 that will partially form an image on a single sheet media 202 in roll form. In other examples, media 202 may be in other than roll form, or may include two or more media sheets arranged such that in a same printing pass marking agent is deposited on the two or more sheets. In this example, print unit 204 is configured to travel back and forth along a guide rod 210 in the directions of scan axis 208. After causing printing of the first swath 202 in a first pass, NAEC component 108 causes media 206 to advance with respect to print unit 204. In an example, the media 206 is advanced in a "y" direction 212 that is substantially perpendicular to scan axis 208. Nominal second swath 214 illustrates a second swath that would be printed by print unit 204 in a second pass of print unit 204 along scan axis 208 absent any swath height corrections made to compensate for media advance errors. In some examples, the first and second passes are consecutive passes, such that there are no other print unit 204 passes occurring between the first and second passes. In other examples, the first and second passes are non-consecutive. It should be noted that the term "second pass" as used in this application is meant to distinguish the second pass and indicate that the second pass occurs sometime after the first pass. The term "second pass" is not, however, meant to imply that the second pass must be a pass that is next or consecutive with respect to the first pass. In some examples, the second pass will be a pass occurring after the first pass, yet is not a pass next following or consecutive to the first pass. In other examples, the second pass will be a pass next following or consecutive to the first pass.

In this example, NAEC component 108 determines that a plurality of media advance errors have taken place such that printing of the nominal second swath 214 without adjustment would result in artifacts that would be visible to a user viewing the printed image. NAEC component 108 makes the determination of non-constant advance errors utilizing data received from a first optical sensor 220 and a second optical sensor 222 that are positioned above media 202 to detect any non-constant media advance error. Examples of non-constant media advance errors that may be detected include, but are not limited to, media skew, media telescoping, and non-constant bunching up of media 202. In an example, the optical sensor is an optical media advance sensor configured to track media movement by tracking a fiducial printed on the media. In an another example, the optical sensor is an optical media advance sensor configured to track media movement by tracking a distinguishing mark that is an attribute of the media itself (e.g., a fiber pattern). In other examples, sensors other than optical sensors may be utilized to identify media advance errors, including but not limited to pressure sensors or acoustic sensors. In examples, less than or more than two sensors may be used to detect media advance errors.

Continuing with the example of FIG. 2, absent adjustments for the detected non-constant advance errors, printing of the image would result in a banding error 216 in which there is unwanted white space or unprinted space between the first swath 206 and the nominal second swath 214. This banding error 216 is the result of an error of over-advancement of media 202 with respect to the scan axis 208 and the advance that is contemplated or expected. Further, in this example absent an adjustment for the non-constant advance errors, printing of the image would result in an overprinting error 218 in which there is excessive marking agent deposited in an area where the between the first swath 206 and the nominal second swath 214. This overprinting error is the result of an error of under-advancement of media 202 with respect to the scan axis 208 and the advance that is contemplated or expected.

Figure 3:
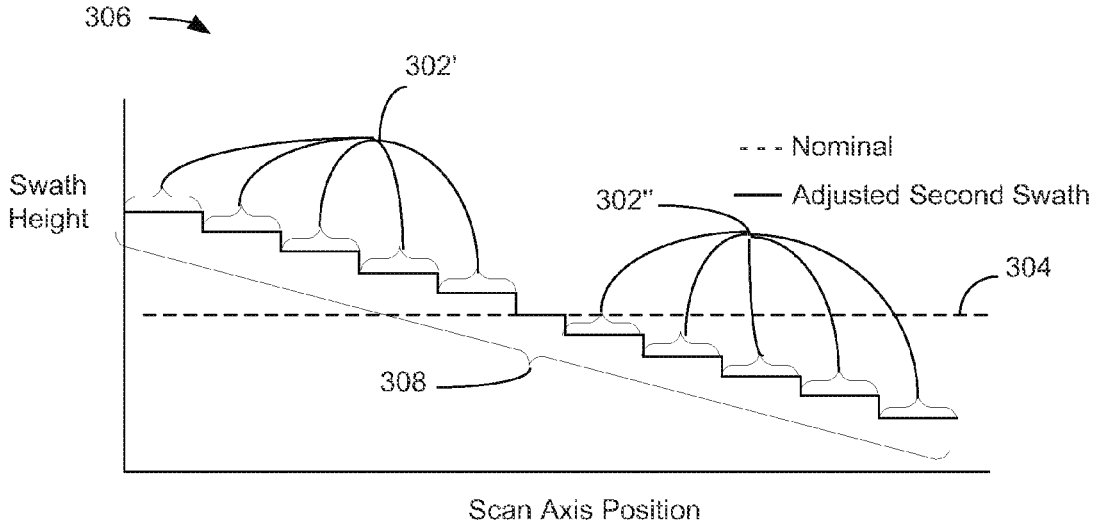
FIG. 3 depicts an example of a non-constant media advance compensation profile, according to various examples.

Moving to FIG. 3, in view of FIGS. 1 and 2, NAEC component 108 generates a profile 306 of non-constant errors recorded in connection with advancing of the media 202 in the y direction 212. In this example, the profile is generated utilizing data received from the first 220 and second 222 optical sensors. In other examples, the profile 306 is a profile that NAEC component 108 receives, rather than NAEC 108 generating the profile. In an example, the profile 306 is a profile that was generated by another system, or by a user, prior to the beginning of a printing operation. The profile 306 is utilized to determine a plurality of media advancement errors at a plurality of locations on the media 202 with respect to print unit 204. While the example profile of FIG. 3 is in stairstep graphic format, in or other examples the profile may include adjustments or increments that are smaller such that the adjusted second swath may appears as straight line. In other examples, the profile may be in a format other than a graph format, including but not limited to an equation, function, list, database, or lookup table.

Figure 4:
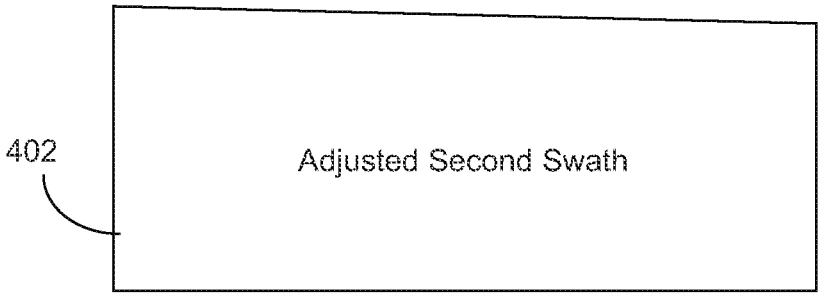
FIG. 4 is an example of printing an adjusted second swath, including adjustments to swath height of a nominal second swath, to correct non-constant media advance errors, according to various examples.

NAEC component 108 next determines a plurality of adjustment regions 302' and 302" along the width of a nominal second swath 214. The second swath, with nominal height 304, is a swath that is to be printed adjacent to the first swath absent of any adjustments to compensate for media 202 advance errors. NAEC component 108 forms an adjusted second swath height 308 by, for each of the regions 302' and 302", adjusting the height 308 of the nominal second swath 214 in memory based on the determined amount of advancement error for the region 302' 302". NAEC component 108 then causes print unit 204 to print the adjusted second swath 402 (FIG. 4). The height adjustment 308 is based on the determined amount of media 202 advancement error with respect to the applicable adjustment region.

For a first set of regions 302' of the second swath, the height 304 of the nominal second swath 214 in each region is increased. This is to reduce a banding image artifact that would occur in the region as a result of a detected over-advancement of the media. For a second set of regions 302" of the second swath, the height 304 of the nominal second swath 214 in each region is decreased to reduce an overprinting image artifact that would occur in the region as a result of a detected under-advancement of the media.

In an example, decreasing the height of height 304 of nominal second swath 214 in a region to form the adjusted second swath 402 (FIG. 4) may include removing image data from the nominal second swath 214. In another example, increasing the height 304 of the nominal second swath 214 in a region to form the adjusted second swath 402 includes repeating or duplicating image data of a lower portion of the first swath 206 that was printed on the media 202 during printing of the first swath.

Figure 5:
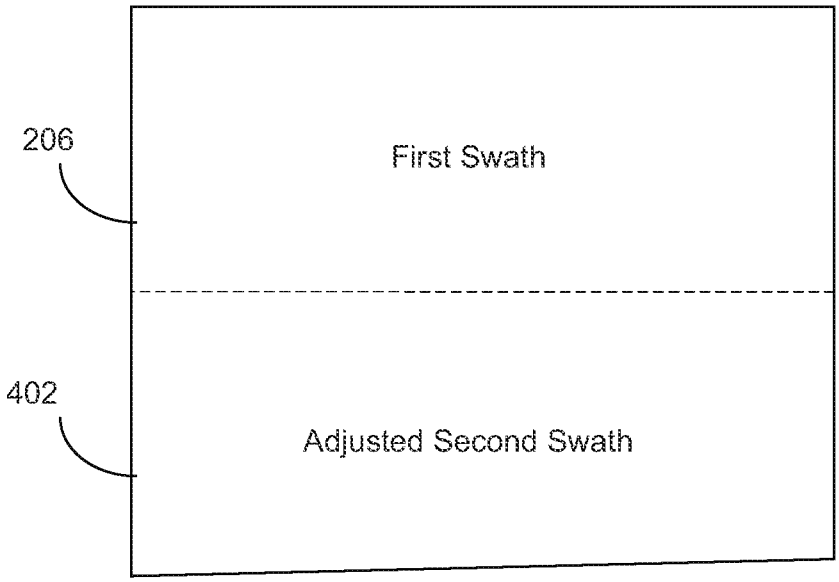
FIG. 5 is an example of printing an adjusted second swath adjacent to a first swath to correct non-constant media advance errors, according to various examples.

FIG. 4 displays a result of printing of the adjusted second swath 402 that includes the nominal second swath 214 with the height adjustments at the plurality of height adjustment regions 302. FIG. 5 illustrates the combined result of the printing of the first swath 206 and the adjusted second swath 402 according to examples of the disclosure. As a result of the adjustments for the non-constant advance errors, the banding error 216 (FIG. 2) and the overprinting error 218 (FIG. 2) that would have occurred absent the nonuniform advance error correction routine are reduced or eliminated.

Figure 6:
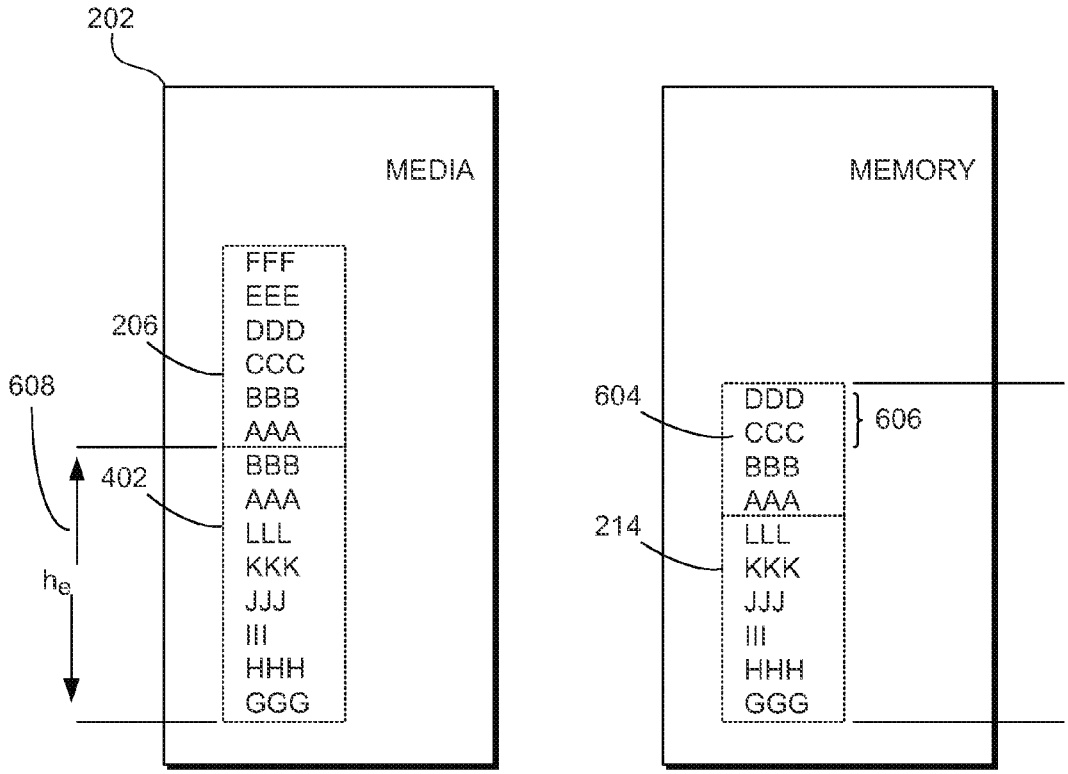
FIG. 6 is an example of increasing the height of a nominal second swath to form an adjusted second swath, including forming a buffer region and applying a masked out portion.
Figure 7:
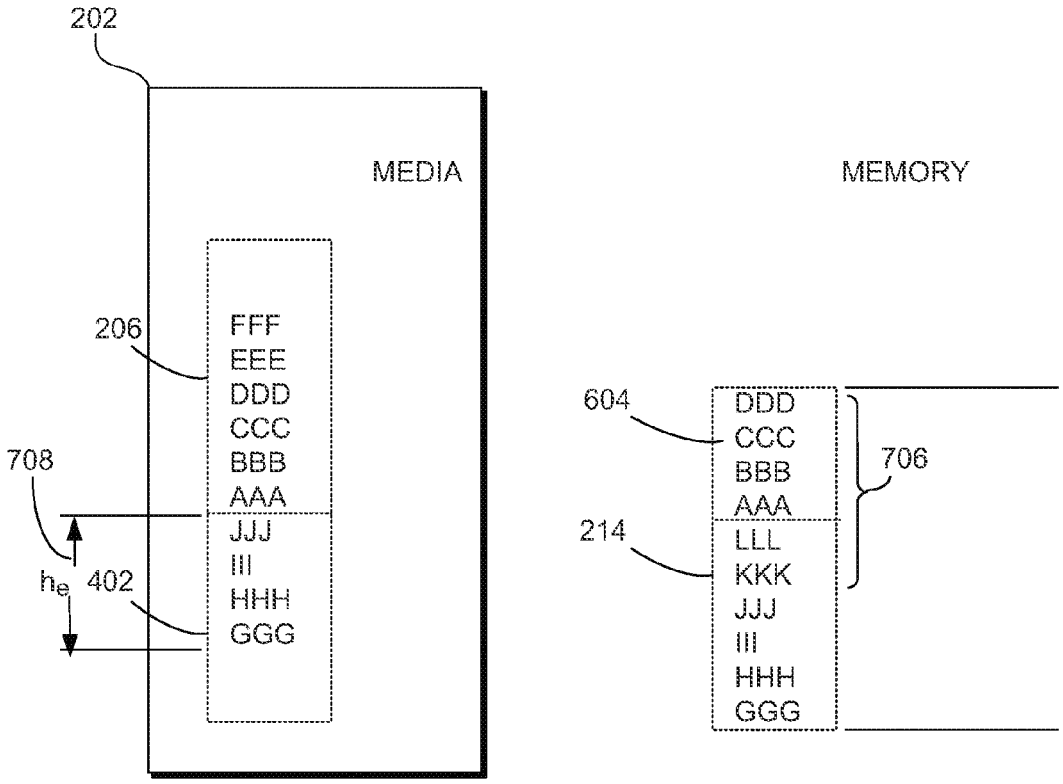
FIG. 7 is an example of decreasing the height of a nominal second swath to form an adjusted second swath, including forming a buffer region and applying a masked out portion.

Moving to FIGS. 6 and 7 in view of FIGS. 1-5, in certain examples adjusting the height of the nominal second swath of a region in memory to form an adjusted second swath includes adding a buffer region to the nominal second swath that repeats image data of a lower portion of the first swath. According to the type of non-constant media advance error detected for the region, a masked out portion 606 of the buffer region 604 is applied to the nominal second swath 214. In the examples of FIGS. 6 and 7, for illustrative purposes, a predetermined number of rows of the buffer region 604 is four. Consequently, the buffer region 604 includes four rows of the lower portion of an example first swath 206 (e.g., AAA, BBB, CCC, and DDD). In an example, the masked out portion 606 706 may be based on at least the determined amount of advancement error. In another example, the masked out portion 606 may be based on the predetermined size of the buffer region 604 and the determined amount of advancement error. For example, the masked out portion 606 706 may correspond to a calculated number of rows of, for example, of the upper portion of the buffer region 604 and/or adjusted second swath 402 such that the calculated number of rows are equal to the number of predetermined rows of the buffer region 604 minus the number of rows of the advancement error.

For illustrative purposes, FIG. 6 illustrates an over-advancement state in which the advancement error is two rows. Referring to FIG. 6, compensation for an over-advancement of two rows (e.g., advancement error of two) results in the masked out portion 606 including two rows (e.g., CCC and DDD) as a result of the two upper rows of the adjusted second swath 402 and/or buffer region 604 being subtracted from the four predetermined number of rows corresponding to the buffer region 604 (e.g., AAA-DDD) according to an example. The print unit 204 subsequently prints the adjusted second swath 402 on the media 202 adjacent to and after the print unit 204 prints the first swath 206 on the media 202. Consequently, the printed adjusted second swath 402 has an effective swath height "he" 608 including eight rows (e.g., GGG-BBB) and does not include the corresponding masked out portion 606. Thus, compensation for the over-advancement state provided in accordance with examples of the present disclosure enables the printing of the adjacent first 206 and second adjusted 402 swaths in a manner to minimize an unintended band region therebetween.

FIG. 7 is a representational diagram illustrating swath adjustment in memory and printing of adjacent swaths on media corresponding to an under-advancement state by the image forming system of FIG. 1 according to an example. For illustrative purposes, FIG. 7 illustrates an under-advancement state in which the advancement error is two rows. Referring to FIG. 7, compensation for an under-advancement of two rows (e.g., advancement error of negative two) results in the masked out portion 706 including six rows (e.g., KKK-DDD) of the adjusted second swath 402 according to an example. The print unit 204 subsequently prints the printed adjusted swath 402 on the media 202 adjacent to and after the print unit 204 prints the corresponding first swath 206 on the media 202. Consequently, the subsequently printed adjusted swath 402 has an effective swath height "he" 708 including four rows (e.g., GGG-JJJ) and does not include the respective six rows (e.g., masked out portion 706) as illustrated in FIG. 7. Thus, compensation for the under-advancement state provided in accordance with examples of the present disclosure enables the first 206 and second adjusted 402 swaths to be printed in a manner to minimize an unintended overlapped region resulting in an increase of fluid density therein.

Returning to FIG. 1, printing device 102 is shown to include a controller 110. As used in this specification, controller 110 represents generally any combination of elements capable of coordinating the operation of media transport unit 104, print unit 106, and non-constant advance error compensation component 108. In a given implementation, the controller 110 includes a processor 112 and a memory 114. The processor 112 may represent multiple processors, and the memory 114 may represent multiple memories. In an example, the controller 110 may include a number of software components that are stored in a computer-readable medium, such as memory 114, and are executable by processor 112. In this respect, the term "executable" includes a program file that is in a form that can be directly (e.g. machine code) or indirectly (e.g. source code that is to be compiled) performed by the processor 112. An executable program may be stored in any portion or component of memory 114.

Figure 8:
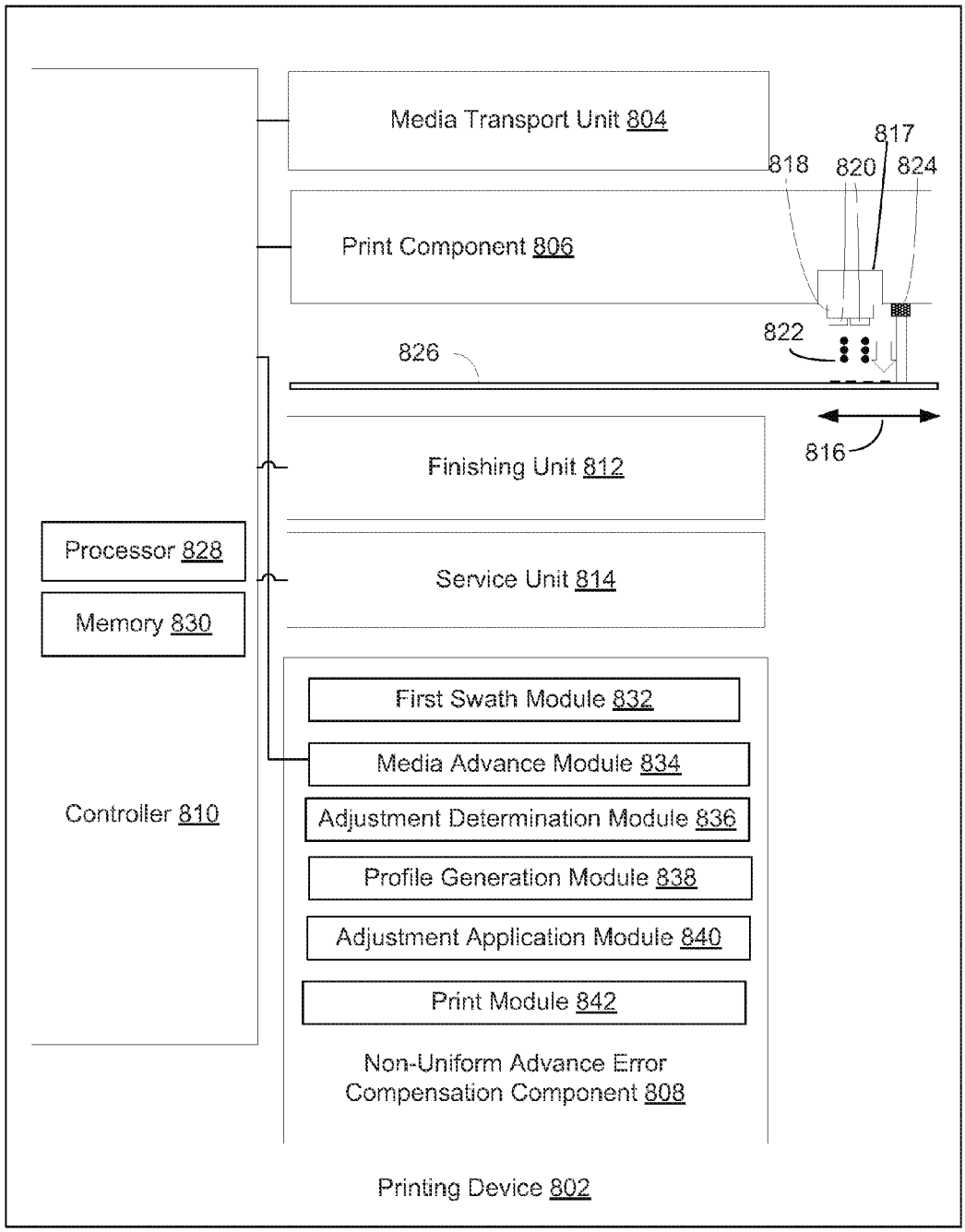
FIG. 8 is a block diagram illustrating a system according to various examples.

FIG. 8 is a block diagram illustrating a system according to various examples. FIG. 8 includes particular components, modules, etc. according to various examples. However, in different examples, more, fewer, and/or other components, modules, arrangements of components/modules, etc. may be used according to the teachings described herein. In addition, various components, modules, etc. described herein may be implemented as one or more software modules, hardware modules, special purpose hardware (e.g., application specific hardware, application specific integrated circuits (ASICs), embedded controllers, hardwired circuitry, etc.), or some combination of these.

FIG. 8 shows a printing device 802 representing generally computing device that is operable to produce printed images upon a media. In the example of FIG. 8, printing device 802 is shown to include a media transport unit 804, a print unit 806, a finishing unit 812, a service unit 814, a non-constant advance error compensation component 808, and a controller 810.

Media transport unit 804 represents generally any combination of hardware and programming capable of transporting a media through printing device 802 in a media transport direction 816 substantially orthogonal to a scan axis for a print unit.

Print component 806 represents generally any combination of elements capable of being utilized to form desired images on a media. In a given example, print component 806 may include a reciprocating carriage 817 supported by a guide rod. In this example, the reciprocating carriage 817 carries a fluid ejection mechanism print unit 818. In an example, print unit 818 includes multiple printheads 820 configured to dispense ink or another marking agent 822.

Finishing unit 812 represents generally any combination of hardware and programming capable of performing a finishing operation on media. Such finishing operations include cutting, folding, laminating or any other action that affects the physical nature of the print medium.

Service unit 814 represents generally any combination of elements capable of being utilized to service print unit 806. Where, for example, print unit 806 includes a printhead 820, service unit 814 may be configured to function as a printhead wiper, priming station, and/or spittoon. Service unit 814 may additionally be configured to function as a color calibrator and/or media alignment calibrator.

As discussed in more detail below with reference to FIG. 9, sensors 824 represents generally any sensors positioned and configured to detect non-constant advances of media 826 caused by errors in the operation of media transport unit 804 or anomalies in the media 826. In this example sensors 824 are shown attached to the chassis of printer 802 above the media 826. In another example, sensors 824 may be located underneath the media so as to be exposed to the backside of a media. In other examples, sensors 824 may be located in other locations within printer 802.

Printing device 802 is shown to include a controller 810. As used in this specification, controller 810 represents generally any combination of elements capable of coordinating the operation of components 804, 806, 812, and 814. In a given implementation, the controller 810 includes a processor 828 and a memory 830. The processor 828 may represent multiple processors, and the memory 830 may represent multiple memories. In an example, the controller 810 may include a number of software components that are stored in a computer-readable medium, such as memory 830, and are executable by processor 828. In this respect, the term "executable" includes a program file that is in a form that can be directly (e.g. machine code) or indirectly (e.g. source code that is to be compiled) performed by the processor 828. An executable program may be stored in any portion or component of memory 830.

Non-constant advance error compensation component ("NAEC component") 808 represents generally any programming, that, when executed, causes changes in swath heights to reduce or eliminate advance error artifacts that can result from media advances that are non-constant along the scan axis. In this example, NAEC component 808 includes a first swath module 832, a media advance module 834, an adjustment determination module 836, a profile generation module 838, an adjustment application module 840, and a print module 842.

Figure 9:
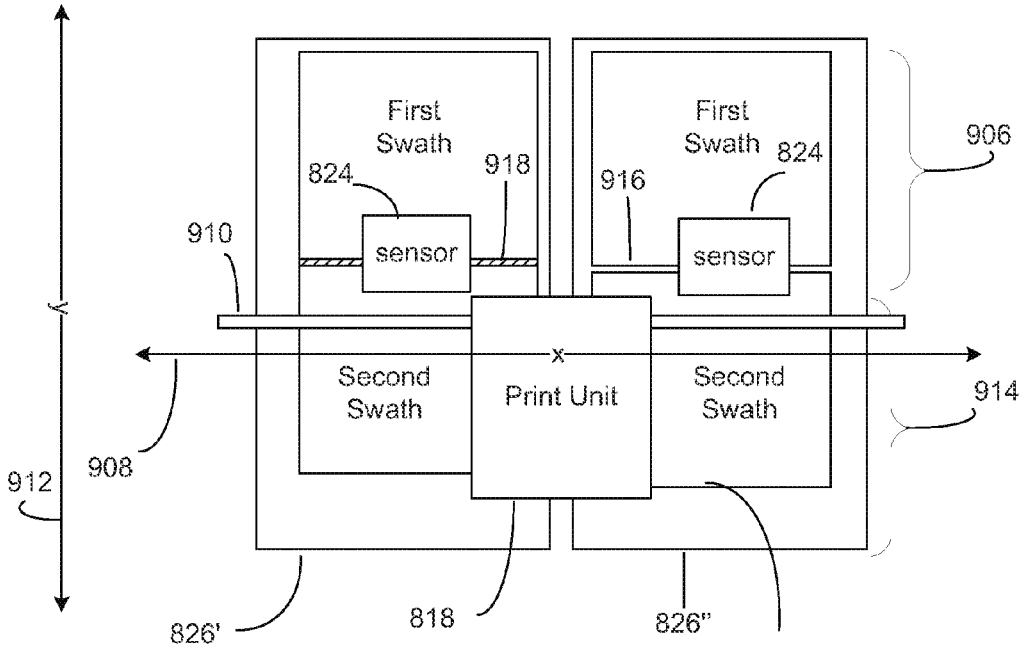
FIG. 9 is an example of printing of a first swath and a nominal second swath upon two sheets of media situated in parallel workflow without correction for non-constant media advance errors, according to various examples.

Moving to FIG. 9 in view of FIG. 8, in an example an NAEC component 808 included within a printing device 802 receives a print job with instructions to print an image upon a media 826. First swath module 832 causes printing, by a print unit 818, of a first swath 906 that will partially form an image on a first roll of media 826' and a second roll of media 826" arranged such that in a same printing pass marking agent is deposited on both first roll 826' and second roll 826". In this example, print unit 818 is configured to travel back and forth along guide rod 910 in the directions of scan axis 908. After causing printing of the first swath 906 in a first pass, media advance module 834 causes medias 826' and 826" to advance with respect to print unit 818. In an example, the medias 826' and 826" are advanced in a "y" direction 912 that is substantially perpendicular to scan axis 908. Nominal second swath 914 illustrates a second swath of approximately 100 mm that would be printed by print unit 818 in a second pass of print unit 818 along scan axis 908 absent any swath height corrections made to compensate for media advance errors. However, in such a dual roll embodiment it can occur that after the media advance following the printing of the first swath 906, a first roll 826' under-advances 0.08 mm (approximately −4 rows advance error for a 1200 dpi printer), while a second roll 826" over-advances 0.04 mm (approximately −+2 rows advance error). This situation would leave an overlap or overprinting of 0.08 mm in the left roll and a gap or banding of 0.04 on the right roll.

In this example, adjustment determination module 836 determines that these media advance errors have taken place such that printing of the nominal second swath 914 without adjustment would result in artifacts that would be visible to user viewing the printed image. Adjustment determination module 836 makes the determination of non-constant advance errors utilizing data received from sensors 824 positioned above media 826 to detect any non-constant media advance error.

Continuing with the example of FIG. 9, absent adjustments for the detected non-constant advance errors, printing of the image would result in a banding error 916 in which there is unwanted white space or unprinted space between the first swath 906 and the nominal second swath 914 on media 826". This banding error is the result of an error of over-advancement of media 826" with respect to the scan axis 908 and the advance that is contemplated or expected. Further, in this example absent an adjustment for the non-constant advance errors, printing of the image would result in an overprinting error 918 in which there is excessive marking agent deposited in an area where the between the first swath 906 and the nominal second swath 914. This overprinting error is the result of an error of under-advancement of media 826' with respect to the scan axis 908 and the advance that is contemplated or expected.

Figure 10:
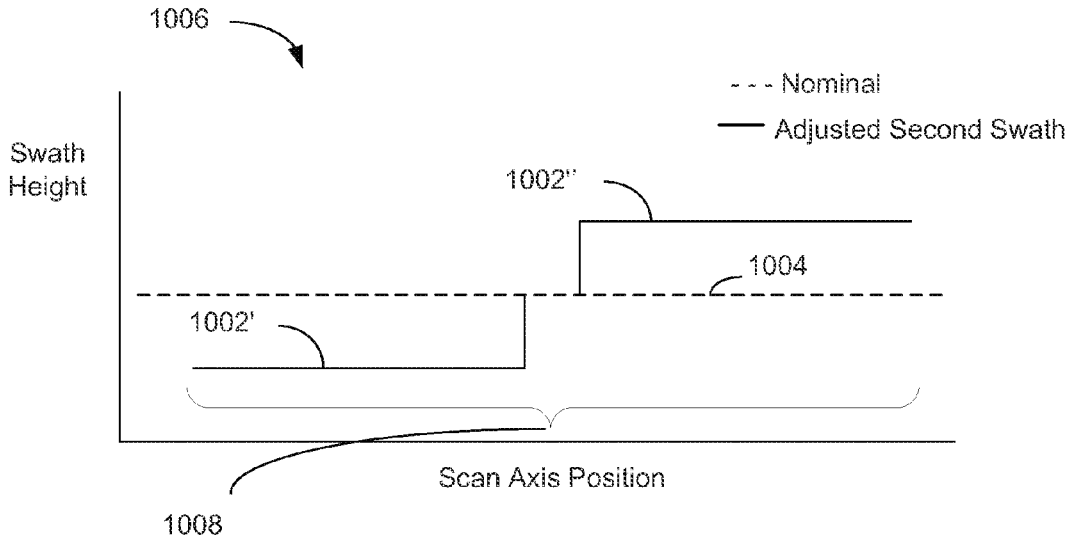
FIG. 10 depicts an example of a non-constant media advance compensation profile, according to various examples.

Moving to FIG. 10, in view of FIGS. 8 and 9, profile generation module 838 generates a profile 1006 of non-constant errors recorded in connection with advancing of the medias 826' and 826" in the y direction 912. In this example, the profile is generated utilizing data received from the optical sensors 824. The profile 1006 is utilized to determine a plurality of media advancement errors at a plurality of locations on the medias 826' and 826" with respect to print unit 818.

Adjustment application module 840 next determines a negative adjustment region 1002' and a positive adjustment region 1002" along the width of a nominal second swath 1004. The nominal second swath, with nominal height 1004, is a swath that is to be printed adjacent to the first swath absent any adjustments to swath height to compensate for media 826 advance errors. Adjustment application module 840 forms an adjusted second swath height 1008 for each of the negative adjustment region 1002' and the positive adjustment region 1002", adjusting the height of the nominal second swath 1004 in memory based on the determined amount of advancement error for the regions 1002' and 1002".

Print module 842 then causes print unit 818 to print the adjusted second swath 1102 (FIG. 11), according to profile 1006. The height adjustment is based on the determined amount of medias 826' and 826" advancement errors with respect to the applicable adjustment region.

For the negative adjustment region 1002' of the second swath, the adjusted second swath height for or in such regions is less than the nominal second swath height 1004. This is to reduce an overprinting image artifact 918 that would occur in the region as a result of a detected under-advancement of the media. For the positive adjustment region 1002" of the second swath, the adjusted second swath height for each region is greater than the nominal second swath height 1004, to reduce a banding image artifact 916 that would occur in the region as a result of a detected over-advancement of the media.

In an example, reduction of height of nominal second swath 1004 in a region to form the adjusted second swath 1102 (FIG. 11) with heights 1008 (FIG. 10) may include removing image data from the nominal second swath. In another example, increase in the height of the nominal second swath 1004 in a region to form the adjusted second swath includes repeating image data of a lower portion of the first swath 906 that was printed on the media 826 during printing of the first swath.

Figure 11:
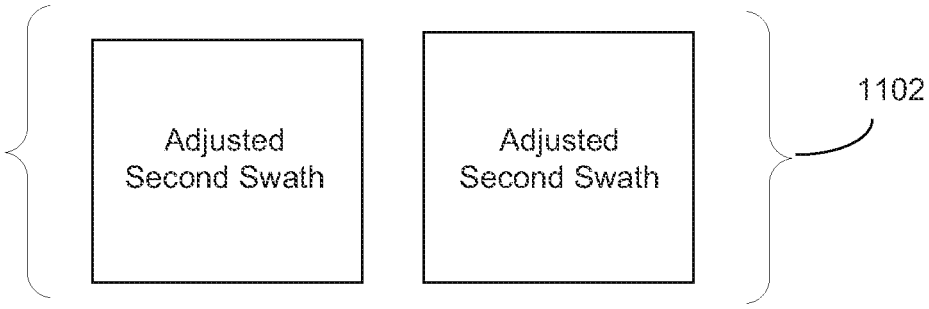
FIG. 11 is an example of an adjusted second swath for correcting non-constant media advance errors, according to various examples.
Figure 12:
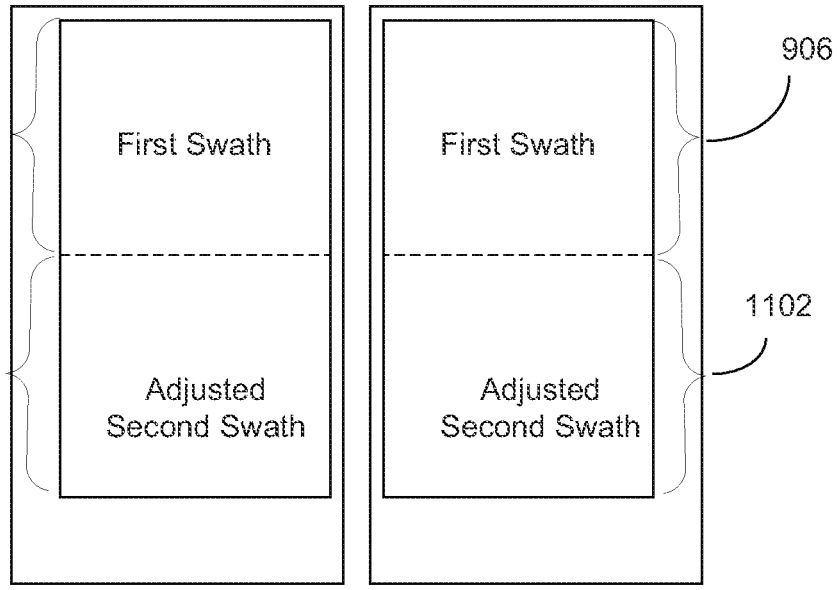
FIG. 12 is an example of printing an adjusted second swath adjacent to a first swath to correct non-constant media advance errors, according to various examples.

FIG. 11 displays a result of printing of the adjusted second swath 1102 that includes the nominal second swath 1004 with the height adjustments at negative adjustment region 1002' and positive adjustment region 1002". FIG. 12 illustrates the combined result of the printing of the first swath 906 and the adjusted second swath 1102 according to examples of the disclosure. As a result of the adjustments for the non-constant advance errors, the banding error 916 and the overprinting error 918 that would have occurred absent the nonuniform advance error correction routine are reduced or eliminated.

The functions and operations described with respect to NAEC component 808 and printing device 802 may be implemented as a computer-readable storage medium containing instructions executed by a processor (e.g., processor 828) and stored in a memory (e.g., memory 830). In a given implementation, processor 828 may represent multiple processors, and memory 830 may represent multiple memories. Processor 828 represents generally any instruction execution system, such as a computer/processor based system or an ASIC (Application Specific Integrated Circuit), a computer, or other system that can fetch or obtain instructions or logic stored in memory 830 and execute the instructions or logic contained therein. Memory 830 represents generally any memory configured to store program instructions and other data.

It should be noted that it is not a requirement to utilize line sensors or other sensors that track media transport errors to identify a non-constant media advance errors. In some situations a profile of non-constant advance errors for a media may be received, rather than generated in real-time during a printing operation. For example, the profile may be prepared offline utilizing existing knowledge regarding the type of print job. Moving to FIG. 13, in an example it may be known by a user or system in advance of a printing operation that printing of a certain print job under certain conditions will cause non-constant deformation of media creating a "smile" pattern caused by alternating overprinting and banding artifacts. The deformation can have an origin of thermal expansion of media, hygroscopic effects due to ink distribution on the media, or other phenomena.

Figure 14:
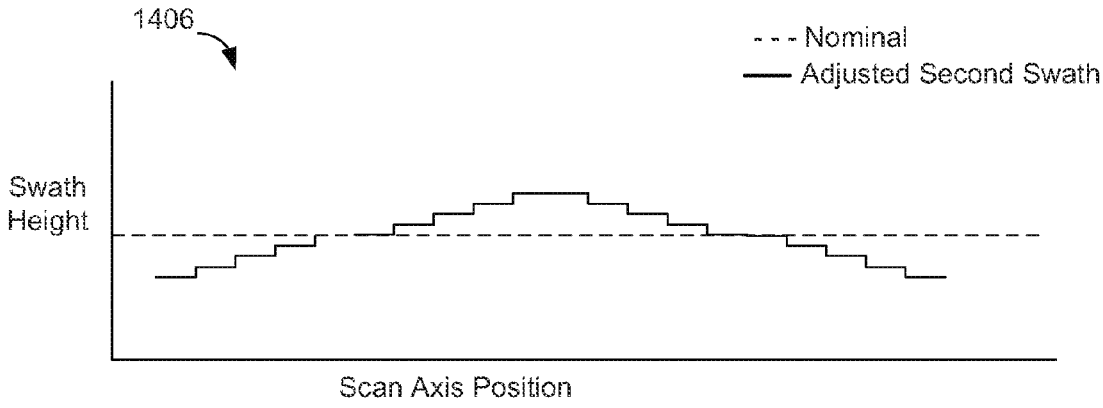
FIG. 14 is an example of an adjusted second swath for correcting non-constant media advance errors, according to various examples.

FIG. 14 illustrates a profile 1406 of non-constant media advance errors. The profile 1406 may be created generated or created external to a printing operation in response to data indicative of an amount of ink distributed upon a test media during printing of the print job by a print unit upon the test media. In examples, a densitometer and/or a spectrophotometer may be utilized to determine the amount of ink distributed upon the test media. In one example. the test media is part of the same media that the first swath and the adjusted second swath are printed on during a printing operation (i.e., another portion of the same media). In another example, the test media for ink distribution measurements is a media that is substantially similar to, but distinct from the media that the first swath and the adjusted second swath are printed on. In another example, the profile 1406 of non-constant advance errors may be received as part of a received rasterized print job. In an example, the print job also may also include instructions to cause a print unit to print the first swath 1306 and the nominal second swath 1304 or an adjusted second swath to at least partially form an image on a media.

Figure 13:
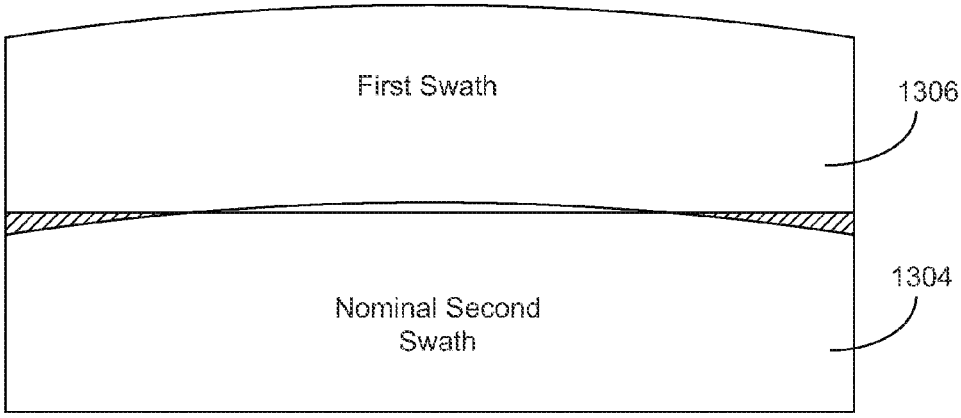
FIG. 13 is an example of printing of a first swath and a nominal second swath upon a single media sheet without correction for non-constant media advance errors, according to various examples.
Figure 15:
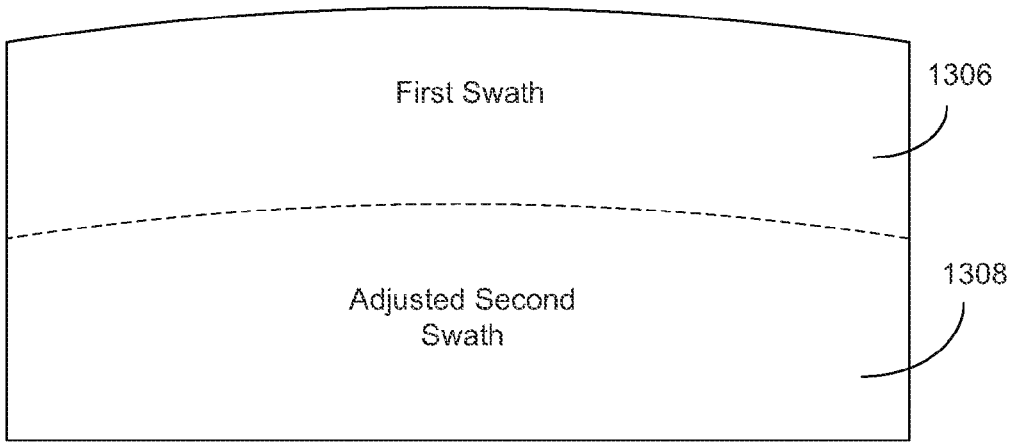
FIG. 15 is an example of printing an adjusted second swath adjacent to a first swath to correct non-constant media advance errors, according to various examples.

FIG. 15 illustrates the combined result of the printing of the first swath 1306 of FIG. 13 and an adjusted second swath 1308 determined utilizing the profile 1406 of non-constant media advance errors of FIG. 14. As a result of the adjustments for the non-constant advance errors, artifacts that would have occurred absent the nonuniform advance error correction routine are reduced or eliminated.

Figure 16:
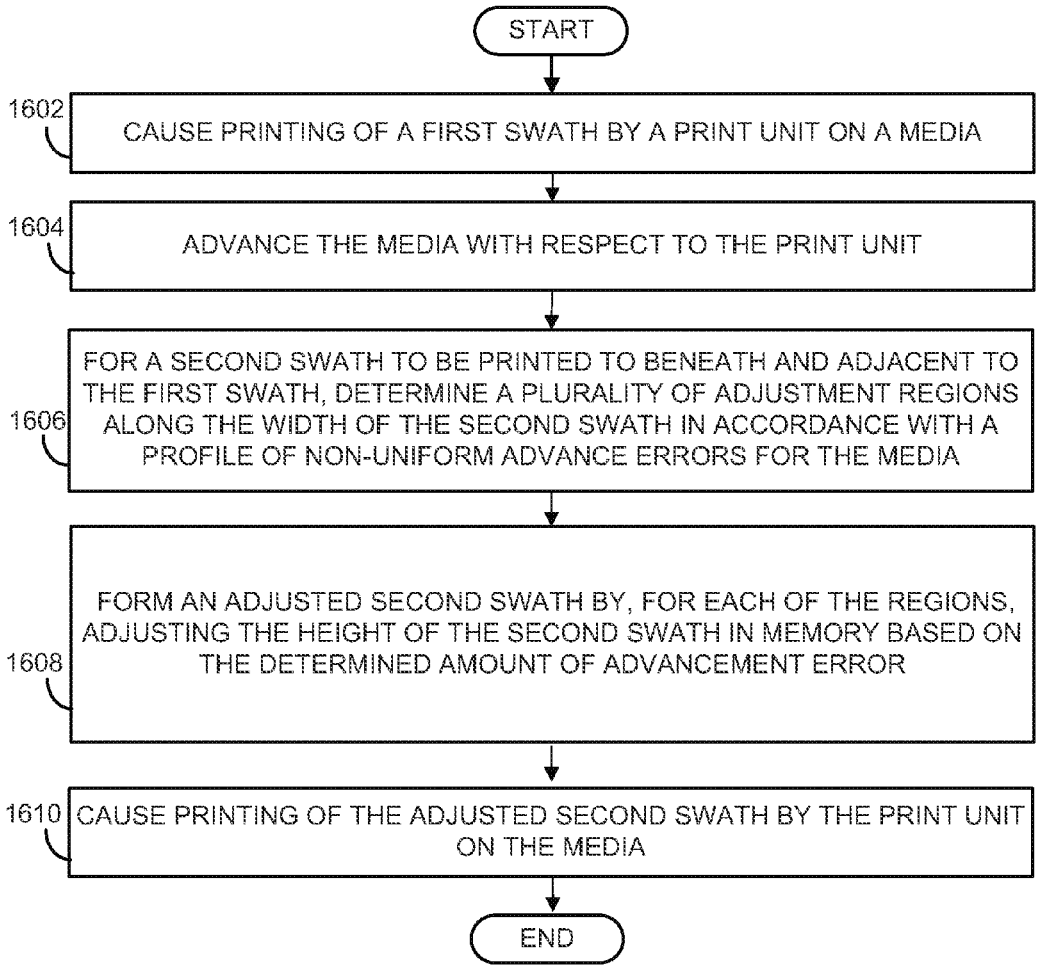
FIG. 16 is a flow diagram depicting steps taken to implement various examples.

FIG. 16 is a flow diagram of operation in a system according to various examples. In discussing FIG. 16, reference may be made to the diagram of FIG. 8 to provide contextual examples. Implementation, however, is not limited to those examples. Starting with FIG. 16, a first swath is caused to be printed by a print unit on a media (block 1602). Referring back to FIG. 8, first swath module 832 may be responsible for implementing block 1602.

Continuing with FIG. 16, the media is advanced with respect to the print unit (block 1604). Referring back to FIG. 8, media advance module 834 may be responsible for implementing block 1604.

Continuing with FIG. 16, for a nominal second swath to be printed to beneath and adjacent to the first swath, a plurality of adjustment regions along the width of the nominal second swath is determined in accordance with a profile of non-constant advance errors for the media (block 1606). Referring back to FIG. 8, adjustment determination module 838 may be responsible for implementing block 1606.

Continuing with FIG. 16, an adjusted second swath is formed by, for each of the regions, adjusting the height of the nominal second swath in memory based on the determined amount of advancement error for the region (block 1608). Referring back to FIG. 8, adjustment application module 840 may be responsible for implementing block 1608.

Continuing with FIG. 16, printing of the adjusted second swath by the print unit on the media is caused (block 1610). Referring back to FIG. 8, print module 842 may be responsible for implementing block 1610.

Various modifications may be made to the disclosed embodiments and implementations without departing from their scope. Therefore, the illustrations and examples herein should be construed in an illustrative, and not a restrictive, sense.

What is claimed is:

1. A non-transitory computer-readable storage medium containing instructions, the instructions when executed by a processor to cause the processor to:

cause printing of a first swath by a print unit on a media that is to be followed by a second swath printed beneath and adjacent to the first swath, the first swath printed without compensating for non-constant advance errors for the media between the first swath and the second swath;

advance the media with respect to the print unit;

for a nominal version of the second swath, determine a plurality of adjustment regions along the width of the nominal version in accordance with a profile of the non-constant advance errors for the media;

form an adjusted version of the second swath by, for each of the regions, adjusting the height of the nominal version in memory based on the determined amount of advancement error for the region; and cause printing of the adjusted version of the second swath by the print unit on the media, with just the adjusted version of the second swath and not the first swath compensating for the non-constant advance errors between the first swath and the second swath.

2. The medium of claim 1, wherein the first swath is printed in a first pass, and the adjusted version of the second swath is printed in a second pass that is not consecutive to the first pass.

3. The medium of claim 1, wherein the instructions cause the processor to generate the profile utilizing data received from a plurality of sensors to determine a plurality of media advancement errors at a plurality of locations with respect to the print unit.

4. The medium of claim 3, wherein the plurality of sensors are optical sensors.

5. The medium of claim 1, wherein the height of the nominal version of the second swath in a region is decreased to reduce an image artifact that would otherwise occur as a result of an under-advancement of the media.

6. The medium of claim 5, wherein decreasing the height includes removing image data from the nominal version of the second swath.

7. The medium of claim 1, wherein the height of the nominal version of the second swath in a region is increased to reduce an image artifact that would otherwise occur as a result of an over-advancement of the media.

8. The medium of claim 7, wherein increasing the height includes repeating image data of a lower portion of the first swath printed on the media during printing of the first swath.

9. The medium of claim 1, wherein forming the adjusted version of the second swath includes adding a buffer region that repeats image data of a lower portion of the first swath to the nominal version of the second swath, and applying a masked out portion to the nominal version of the second swath according to the type of advance error.

10. The medium of claim 1, wherein the media is a single sheet media.

11. The medium of claim 1, wherein the media includes a first sheet and a separate second sheet, wherein during printing of the print job the print unit prints the first swath on both the first and second sheets in a first pass, and prints the nominal version of the second swath or the second adjusted swath on both the first and second sheets in a second pass, wherein advancing the media includes advancing both sheets substantially in parallel with respect to the print unit.

12. The medium of claim 1, wherein the instructions cause the processor to receive a rasterized print job including instructions to cause the print unit to print the first swath and the nominal version of the second swath or the adjusted version of the second swath to at least partially form an image on a media.

13. The medium of claim 12, wherein the profile is a profile generated prior to printing of the first swath, and generated responsive to data indicative of a deformation of a media.

14. The medium of claim 12, wherein the profile is a profile generated prior to printing of the first swath and generated responsive to data indicative of an amount of ink distributed upon a media during printing of the print job by the print unit.

15. The medium of claim 12, wherein the profile is a profile generated prior to printing of the first swath and generated responsive to data indicative of an amount of heat applied to a media during printing of the print job by the print unit.

16. A system, comprising:

a first swath module, configured to cause printing of a first swath by a print unit on a media;

a media advance module, configured to advance the media with respect to the print unit;

an adjustment determination module, configured to, for a nominal second swath to be printed beneath and adjacent to the first swath, determine a plurality of adjustment regions along the width of the nominal second swath in accordance with a profile of non-constant advance errors for the media;

an adjustment implementation module, configured to form an adjusted second swath by, for each of the regions, adjusting the height of the nominal second swath in memory, based on the determined amount of advancement error; and cause printing of the second swath by the print unit on the media, wherein, for at least one region, one of:

the height of the nominal second swath is reduced by removing imaging data from the nominal second swath;

the height of the nominal second swath is increased by duplicating image data of a lower portion of the first swath that was printed on the media during printing of the first swath.

17. The system of claim 16, further comprising a profile generation module, configured to generate the profile utilizing data received from a sensor to determine a plurality of media advancement errors at a plurality of locations with respect to the print unit.

18. A non-transitory computer-readable storage medium containing instructions, the instructions when executed by a processor to cause the processor to:

cause printing of a first swath by a print unit on a media;

advance the media with respect to the print unit;

generate a profile of non-constant advance errors for the media utilizing data received from a plurality of optical sensors to determine a plurality of media advancement errors at a plurality of locations with respect to the print unit;

for a nominal second swath to be printed beneath and adjacent to the first swath, determine a plurality of adjustment regions along the width of the nominal second swath in accordance with the profile;

form a second swath by, for each of the regions, adjusting the height of the nominal second swath in memory, based on the determined amount of advancement error, wherein if it is determined the advancement error is an over-advancement of the media for a region, the adjusted second swath for the region is formed by increasing the height of the nominal second swath;

wherein if it is determined the advancement error is an under-advancement of the media for a region, the adjusted second swath for the region is formed by decreasing the height of the nominal second swath; and cause printing of the second swath by the print unit on the media.

* * * * *